US005782544A

United States Patent [19]

Johnson, Sr.

[11] Patent Number: 5,782,544

[45] Date of Patent: Jul. 21, 1998

[54] HOUSING FOR AN ENTERTAINMENT SYSTEM

[76] Inventor: David Johnson, Sr., 5732 N. 17th St., Philadelphia, Pa. 19141

[21] Appl. No.: 771,026

[22] Filed: Dec. 20, 1996

[51] Int. Cl.[6] ..... A47B 81/06

[52] U.S. Cl. ..... 312/7.2; 312/100; 312/291; 312/321.5; 454/193

[58] Field of Search ..... 49/63, 67; 312/100, 312/102, 213, 291, 409, 406, 7.2, 8.16, 236; 454/185, 193

[56] References Cited

U.S. PATENT DOCUMENTS

| | | | |
|---|---|---|---|
| 2,068,591 | 1/1937 | Bennet | 312/236 |
| 4,166,343 | 9/1979 | O'Brien et al. . | |
| 4,549,841 | 10/1985 | Ishige . | |
| 4,570,392 | 2/1986 | Oltman et al. . | |
| 5,336,049 | 8/1994 | Herman | 312/236 |
| 5,378,119 | 1/1995 | Goertzen | 312/236 |

*Primary Examiner*—James R. Brittain
*Assistant Examiner*—Gerald A. Anderson

[57] ABSTRACT

A housing for an entertainment system is provided including a housing having a top face, a bottom face, a front face, a rear face, and a pair of side faces defining an interior space. The front face has a cut out formed therein with a recess formed about a top edge and pair of side edges thereof. The housing further includes an inner door hingably coupled along a side edge thereof a first predetermined distance from the recess of the front face within the interior space and further adapted to open outwardly thereby allowing selective access to the interior space. The housing further includes a pair of outer doors hingably coupled at outer side edges thereof to each side edge of the recess of the front face. As such, the outer doors are adapted to swing outwardly between an open orientation and a closed orientation with the outer doors residing within the recess and an intermediate space defined between the inner door and outer doors. Further provided is a shelf assembly including at least one shelf situated within the interior space of the housing between the inner door and the rear face thereof. A plurality of accessory containers are mounted to the rear face of the pair of outer doors, wherein the accessory containers are adapted to be disposed within the space when the inner doors and outer doors are closed.

8 Claims, 3 Drawing Sheets

HOUSING FOR AN ENTERTAINMENT SYSTEM

BACKGROUND OF THE INVENTION

1. Field of the Invention

The present invention relates to a new and improved housing for an entertainment system and, more particularly, pertains to allowing the utilization and safe storage of a home entertainment system.

2. Description of the Prior Art

The use of containers for home entertainment systems is known in the prior art. More specifically, furniture for home entertainment systems heretofore devised and utilized for the purpose of supporting a home entertainment system are known to consist basically of familiar, expected, and obvious structural configurations, notwithstanding the myriad of designs encompassed by the crowded prior art which has been developed for the fulfillment of countless objectives and requirements.

By way of example, the prior art includes U.S. Pat. No. 4,570,392 to Oltman et al.; U.S. Pat. No. 4,166,343 to O'Brian et al.; U.S. Patent Des. 325,979 to Mahler; U.S. Pat. No. 4,549,841 to Ishige; U.S. Patent Des. 305,690 to Paul et al.; and U.S. Patent Des. 329,705 to Forsyth.

In this respect, the housing for an entertainment system according to the present invention substantially departs from the conventional concepts and designs of the prior art, and in doing so provides an apparatus primarily developed for the purpose of allowing the utilization and safe storage of a home entertainment system.

Therefore, it can be appreciated that there exists a continuing need for a new and improved housing for an entertainment system which can be used for allowing the utilization and safe storage of a home entertainment system. In this regard, the present invention substantially fulfills this need.

SUMMARY OF THE INVENTION

In view of the foregoing disadvantages inherent in the known types of containers for home entertainment systems now present in the prior art, the present invention provides a new and improved housing for an entertainment system. As such, the general purpose of the present invention, which will be described subsequently in greater detail, is to provide a new and improved housing for an entertainment system and methods which have all the advantages of the prior art and none of the disadvantages.

To attain this, the present invention essentially comprises a housing constructed from steel, aluminum, or heavy plastic with a rectilinear configuration having a top face, a bottom face, a front face, a rear face, and a pair of side faces defining an interior space. As shown in FIGS. 1 and 2, the front face has a rectangular cut out formed therein. A recess is formed about a top edge and pair of side edges thereof, wherein the recess has a uniform width and depth. For allowing the utilization of an air vent, a cut out is centrally formed in the rear face of the housing. For precluding entry of rain and debris into the housing, the air vent has a plurality of downwardly angled strips and a duct. Further provided is an inner door with a front face, a rear face, and a periphery. The inner door is hingably coupled along a side edge thereof a first predetermined distance from the recess of the front face within the interior space. By this structure, the inner door is adapted to open outwardly thereby allowing selective access to the interior space. The housing further includes a pair of outer doors each with a front face, a rear face, and a periphery with the outer doors hingably coupled at outer side edges thereof to each side edge of the recess of the front face. As such, the outer doors are adapted to swing outwardly between an open orientation and a closed orientation. The closed orientation is defined by the outer doors residing within the recess and an intermediate space being defined between the inner door and outer doors having a depth equal to the first predetermined distance. As best shown in FIGS. 2 and 5, a shelf assembly is included. Such assembly consists of a plurality of planar horizontally oriented shelves situated within the interior space of the housing between the inner door and the rear face thereof. For allowing access to items stored thereon, each shelf including means of sliding within a horizontal plane between a first orientation located within the interior space of the housing and a second orientation located partially exterior of the housing. Preferably, the shelves include a bottom shelf located adjacent the bottom face of the housing for supporting a television. The shelves also ideally include an intermediate shelf located above the bottom shelf located approximately within a horizontal plane which bisects the housing, wherein the intermediate shelf is adapted to support a video cassette recorder. For supporting a stereo and/or clock, a top shelf is situated above the intermediate shelf a distance which is about half that between the bottom shelf and intermediate shelf. Associated with the VCR, stereo, and television are speakers secured to the inner face of the outer doors. To ensure there is space for the speakers, it is preferred that they protrude a distance less than the first predetermined distance. Further provided is a plurality of accessory containers mounted to the rear face of the pair of outer doors. As shown in FIGS. 1 & 2, the accessory containers include a phone container with an open top face for accepting a conventional phone therein. Such container has a depth less than the first predetermined distance. For containing a plurality of remote controllers and further allowing the convenient dispensing thereof, the accessory containers further include a remote control container having first portion and further a second portion with a height that is less than that of the first portion. It should be noted that the first portion is in communication with the second portion, as shown in the Figures. Similar to the phone container, the remote control container has a depth less than the first predetermined distance.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved housing for an entertainment system which has all the advantages of the prior art containers for home entertainment systems and none of the disadvantages.

It is another object of the present invention to provide a new and improved housing for an entertainment system which may be easily and efficiently manufactured and marketed.

It is a further object of the present invention to provide a new and improved housing for an entertainment system which is of a durable and reliable construction.

An even further object of the present invention is to provide a new and improved housing for an entertainment system which is susceptible of a low cost of manufacture with regard to both materials and labor, and which accordingly is then susceptible of low prices of sale to the consuming public, thereby making such a housing for an entertainment system economically available to the buying public.

Even still another object of the present invention is to allow the utilization and safe storage of a home entertainment system.

Lastly, it is an object of the present invention to provide a housing for an entertainment system including a housing constructed from steel, aluminum, or heavy plastic having a top face, a bottom face, a front face, a rear face, and a pair of side faces defining an interior space. The front face has a cut out formed therein with a recess formed about a top edge and pair of side edges thereof. The housing further includes an inner door with a front face, a rear face, and a periphery. The inner door is hingably coupled along a side edge thereof a first predetermined distance from the recess of the front face within the interior space and further adapted to open outwardly thereby allowing selective access to the interior space. The housing further includes a pair of outer doors each with a front face, a rear face, and a periphery with the outer doors hingably coupled at outer side edges thereof to each side edge of the recess of the front face. As such, the outer doors are adapted to swing outwardly between an open orientation and a closed orientation with the outer doors residing within the recess and an intermediate space defined between the inner door and outer doors. Further provided is a shelf assembly including at least one shelf situated within the interior space of the housing between the inner door and the rear face thereof. A plurality of accessory containers are mounted to the rear face of the pair of outer doors, wherein the accessory containers are adapted to be disposed within the space when the inner doors and outer doors are closed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
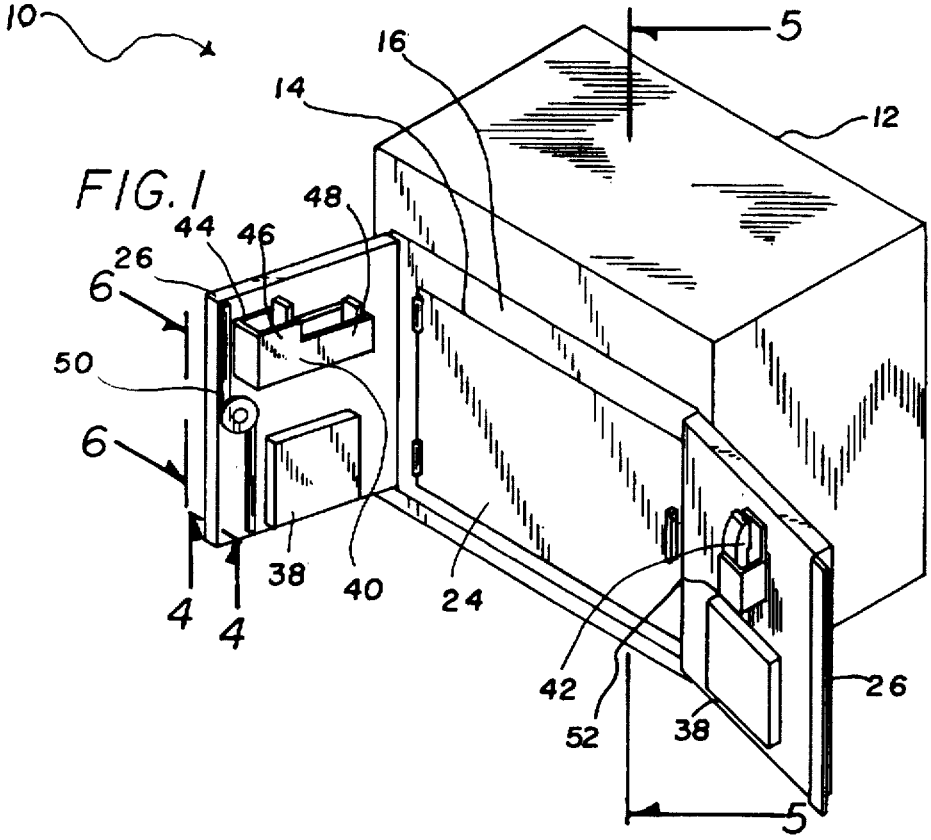
FIG. 1 is a perspective illustration of the preferred embodiment of the housing for an entertainment system constructed in accordance with the principles of the present invention.

With reference now to the drawings, and in particular to FIGS. 1 through 6 thereof, the preferred embodiment of the new and improved housing for an entertainment system embodying the principles and concepts of the present invention and generally designated by the reference numeral 10 will be described.

The present invention, the new and improved housing for an entertainment system is a system 10 comprised of a plurality of components. Such components, in their broadest context, include a housing, a shelf assembly, a plurality of containers, and a handle. Each of the individual components is specifically configured and correlated one with respect to the other so as to attain the desired objectives.

Figure 2:
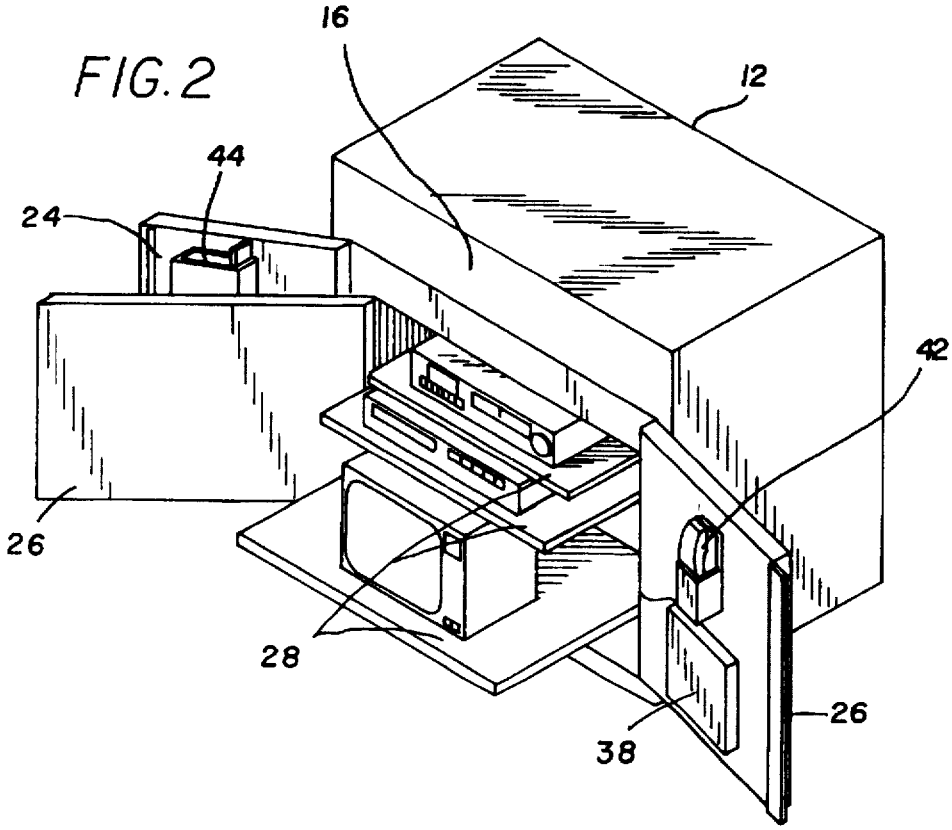
FIG. 2 is another perspective view of the present invention with the inner door thereof in an open orientation.
Figure 3:
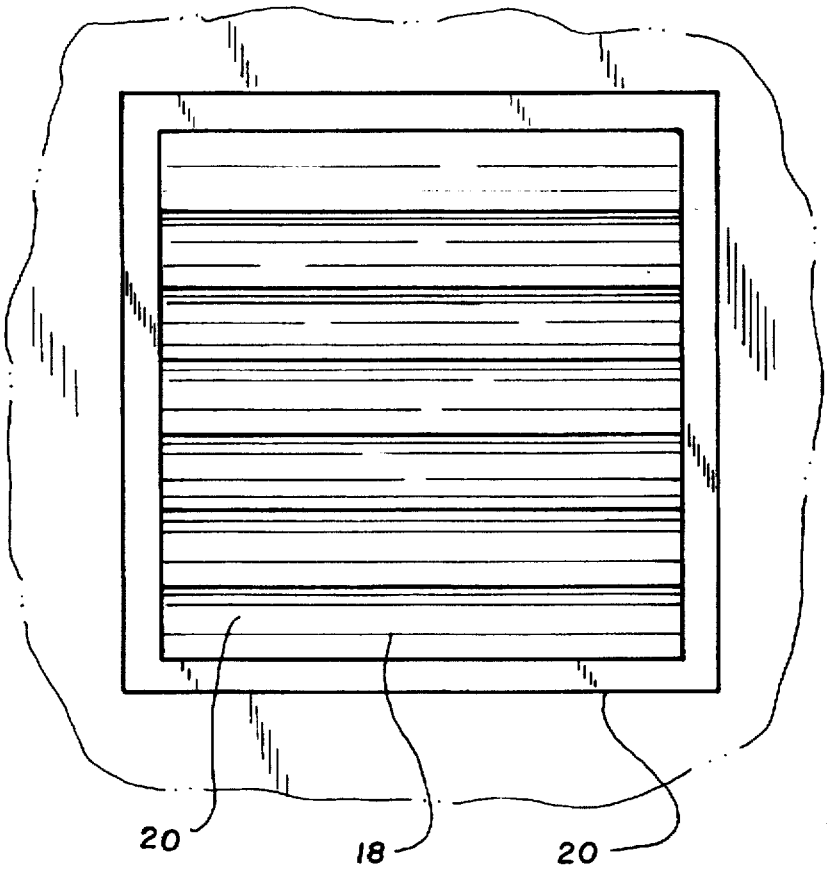
FIG. 3 is a cut away view of the vent of the present invention.
Figure 4:
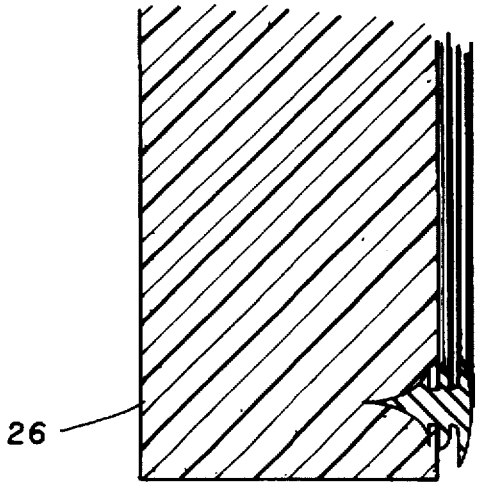
FIG. 4 is a side view of one of the outer doors with the weather strip thereof.
Figure 6:
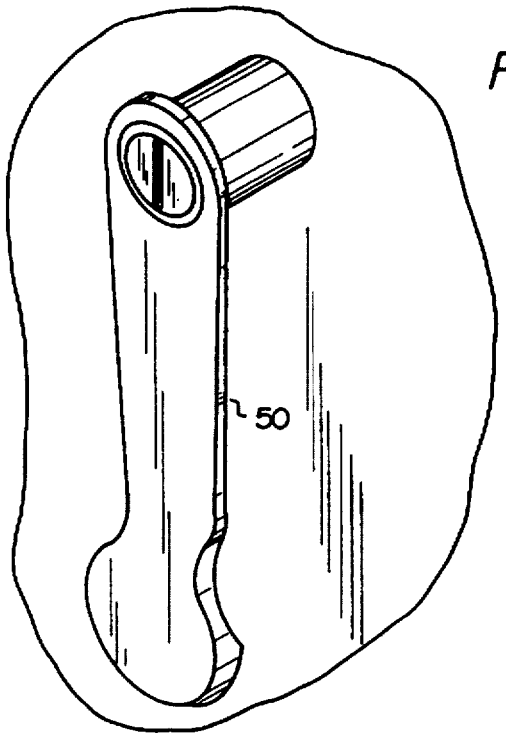
FIG. 6 is a perspective view of the present invention depicting the handle thereof.

More specifically, the system 10 of the present invention includes a housing 12 constructed from steel, aluminum, or heavy plastic with a rectilinear configuration having a top face, a bottom face, a front face, a rear face, and a pair of side faces defining an interior space. As shown in FIGS. 1 and 2, the front face has a rectangular cut out 14 formed therein. A recess 16 is formed about a top edge and pair of side edges thereof, wherein the recess has a uniform width and depth. For allowing the utilization of an air vent 18, a cut out 20 is centrally formed in the rear face of the housing. For precluding entry of rain and debris into the housing, the air vent has a plurality of downwardly angled strips 22. As shown in FIG. 6, a duct is formed in the housing. Such duct is in communication with the vent 18 and further extends upwardly in the rear face of the housing and further extends along the top face whereat the duct is in communication with the interior space of the housing for affording ventilation.

The housing further includes an inner door 24 with a front face, a rear face, and a periphery. The inner door is hingably coupled along a side edge thereof a first predetermined distance from the recess of the front face within the interior space. By this structure, the inner door is adapted to open outwardly thereby allowing selective access to the interior space. The housing further includes a pair of outer doors 26 each with a front face, a rear face, and a periphery with the outer doors hingably coupled at outer side edges thereof to each side edge of the recess of the front face. As such, the outer doors are adapted to swing outwardly between an open orientation and a closed orientation. The closed orientation is defined by the outer doors residing within the recess and an intermediate space being defined between the inner door and outer doors having a depth equal to the first predetermined distance of less than 6 inches. Preferably, to protect the contents of the housing, the outer doors include a weather strip formed about the entire periphery of the rear face thereof.

Figure 5:
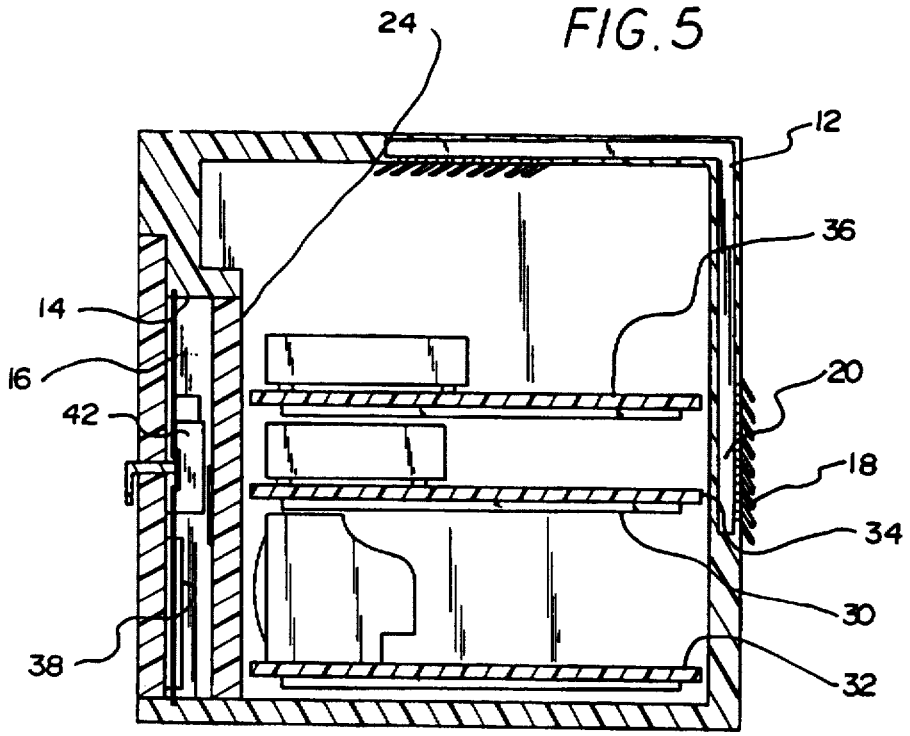
FIG. 5 is a cross-sectional view of the housing taken along line 5—5 shown in FIG. 1.

As best shown in FIGS. 2 and 5, a shelf assembly 28 is included. Such assembly consists of a plurality of planar horizontally oriented shelves situated within the interior space of the housing between the inner door and the rear face thereof. For allowing access to items stored thereon, each shelf including means 30 of sliding within a horizontal plane between a first orientation located within the interior space of the housing and a second orientation located partially exterior of the housing. The sliding means ideally comprises a ball bearing mechanism for smooth, effortless translation. Preferably, the shelves include a bottom shelf 32 located adjacent the bottom face of the housing for supporting a television. The shelves also ideally include an intermediate shelf 34 located above the bottom shelf located approximately within a horizontal plane which bisects the housing, wherein the intermediate shelf is adapted to support a video cassette recorder. For supporting a stereo, a top shelf 36 is situated above the intermediate shelf a distance which is about half that between the bottom shelf and intermediate shelf. Associated with the VCR, stereo, and television are speakers 38 secured to the inner face of the outer doors. To ensure there is space for the speakers, it is preferred that they protrude a distance less than the first predetermined distance.

Further provided is a plurality of accessory containers 40 mounted to the rear face of the pair of outer doors. As shown in FIGS. 1 & 2, the accessory containers include a phone container 42 with an open top face for accepting a conventional phone therein. Such container has a depth less than the first predetermined distance. For containing a plurality of remote controllers and further allowing the convenient dispensing thereof, the accessory containers further include a remote control container 44 having first portion 46 and further a second portion 48 with a height that is less than that of the first portion. It should be noted that the first portion is in communication with the second portion, as shown in the Figures. Similar to the phone container, the remote control container has a depth less than the first predetermined distance.

With reference to FIG. 6, a handle 50 is formed of a rod pivotally coupled at a first end thereof to the front face of one of the outer doors. In use, the handle allows selective access to the inner doors and the interior space of the housing. To accomplish such, the handle preferably comprises a key hole in which a key may be inserted to effect the locking and unlocking thereof. On the rear face of the door to which the handle is coupled, a circular plate is coupled to the handle via a post extending through the door, as best shown in FIG. 1. Pivotally coupled to diametrically opposed sides of the circular plate are a pair of vertically extending rods which are adapted to engage apertures of the housing when the handle is locked. To ensure both doors are precluded from opening when the vertical extending rods are engaged within the apertures, a lip is formed on an end of the door to which the handle is not coupled. It is imperative that such door is closed first to effect proper operation of the present invention.

Associated with the phone is a phone cut off switch 52 which is adapted to deactivate the phone when the outer doors are closed and further allow normal operation of the phone when the doors are opened. See FIG. 1. As such, the phone will not ring when it is inaccessible within the housing. It should be noted that, while not illustrated, the present invention may include an alarm, and a light situated with in the interior space of the housing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved housing for an entertainment system comprising, in combination:

a housing with a rectilinear configuration having a top face, a bottom face, a front face, a rear face, and a pair of side faces defining an interior space, the front face having a rectangular cut out formed therein with a recess formed about a top edge and pair of side edges thereof, wherein the recess has a uniform width and depth, the rear face including a square cut out centrally formed therein with an air vent secured thereover, the air vent having a plurality of downwardly angled strips for precluding entry of rain and debris into the housing, the housing further including an inner door with a front face, a rear face, and a periphery, the inner door being hingably coupled along a side edge thereof a first predetermined distance from the recess of the front face within the interior space and further adapted to open outwardly thereby allowing selective access to the interior space, the housing further including a pair of outer doors each with a front face, a rear face, and a periphery with the outer doors hingably coupled at outer side edges thereof to each side edge of the recess of the front face, whereby the outer doors are adapted to swing outwardly between an open orientation and a closed orientation with the outer doors residing within the recess and an intermediate space defined between the inner door and outer doors having a depth equal to the first predetermined distance;

a shelf assembly including a plurality of planar horizontally oriented shelves situated within the interior space of the housing between the inner door and the rear face thereof, each shelf including means of sliding within a horizontal plane between a first orientation located within the interior space of the housing and a second orientation located partially exterior of the housing, the shelves including a bottom shelf located adjacent the bottom face of the housing for supporting a television, an intermediate shelf located above the bottom shelf located approximately within a horizontal plane which bisects the housing wherein the intermediate shelf is adapted to support a video cassette recorder, and a top shelf situated a distance above the intermediate shelf which is about half that between the bottom shelf and intermediate shelf, wherein a pair of speakers associated with the video cassette recorder and the television are secured to the inner face of the outer doors and protrude therefrom a distance less than the first predetermined distance;

a plurality of accessory containers mounted to the rear face of the pair of outer doors, the accessory containers including a phone container with an open top face for accepting a conventional phone therein and a depth less than the first predetermined distance, the accessory containers further including a remote control container having first portion and further a second portion with a height that is less than that of the first portion, the first portion being in communication with the second portion, wherein the remote control container also has a depth less than the first predetermined distance; and a handle formed of a rod pivotally coupled at a first end thereof to the front face of one of the outer doors for allowing selective access to the inner doors and the interior space of the housing.

2. A housing for an entertainment system comprising:

a housing having a top face, a bottom face, a front face, a rear face, and a pair of side faces defining an interior space, the front face having a cut out formed therein with a recess formed about a top edge and pair of side edges thereof, the housing further including an inner door with a front face, a rear face, and a periphery, the inner door being hingably coupled along a side edge thereof a first predetermined distance from the recess of the front face within the interior space and further adapted to open outwardly thereby allowing selective access to the interior space, the housing further including a pair of outer doors each with a front face, a rear face, and a periphery with the outer doors hingably coupled at outer side edges thereof to each side edge of the recess of the front face, whereby the outer doors are adapted to swing outwardly between an open orientation and a closed orientation with the outer doors residing within the recess and an intermediate space defined between the inner door and outer doors having a depth equal to the first predetermined distance;

a shelf assembly including at least one shelf situated within the interior space of the housing between the inner door and the rear face thereof; and a plurality of accessory containers mounted to the rear face of the pair of outer doors, wherein the accessory containers are adapted to be disposed within the space when the inner doors and outer doors are closed.

3. A housing for an entertainment system as set forth in claim 2 wherein each shelf including means of sliding within a horizontal plane between a first orientation located within the interior space of the housing and a second orientation located partially exterior of the housing.

4. A housing for an entertainment system as set forth in claim 2 wherein the shelves include a bottom shelf located adjacent the bottom face of the housing for supporting a television, an intermediate shelf located above the bottom shelf located approximately within a horizontal plane which bisects the housing wherein the intermediate shelf is adapted to support a video cassette recorder, and a top shelf situated a distance above the intermediate shelf which is about half that between the bottom shelf and intermediate shelf.

5. A housing for an entertainment system as set forth in claim 4 wherein a pair of speakers associated with the video cassette recorder and the television are secured to the inner face of the outer doors and protrude therefrom a distance less than the first predetermined distance.

6. A housing for an entertainment system as set forth in claim 2 wherein the rear face includes a square cut out centrally formed therein with an air vent secured thereover, the air vent having a plurality of downwardly angled strips for precluding entry of rain and debris into the housing.

7. A housing for an entertainment system as set forth in claim 2 wherein the accessory containers include a phone container with an open top face for accepting a conventional phone therein and a depth less than the first predetermined distance, the accessory containers further including a remote control container having first portion and further a second portion with a height that is less than that of the first portion, the first portion being in communication with the second portion, wherein the remote control container also has a depth less than the first predetermined distance.

8. A housing for an entertainment system as set forth in claim 2 and further including a handle formed of a rod pivotally coupled at a first end thereof to the front face of one of the outer doors for allowing selective access to the inner doors and the interior space of the housing.

* * * * *